United States Patent [19]

Okuyama

[11] Patent Number: 5,037,036

[45] Date of Patent: Aug. 6, 1991

[54] YARN END FINDING APPARATUS

[75] Inventor: Yasuo Okuyama, Ohtsu, Japan

[73] Assignee: Murata Kikai Kabushiki Kaisha, Kyoto, Japan

[21] Appl. No.: 363,612

[22] Filed: Jun. 7, 1989

[30] Foreign Application Priority Data

Jun. 8, 1988 [JP] Japan ..... 63-140852

[51] Int. Cl.[5] ..... D01H 13/26

[52] U.S. Cl. ..... 242/35.6 E; 57/262; 57/350; 242/18 R

[58] Field of Search ..... 57/262, 281, 350; 242/35.6 E, 35.5 A

[56] References Cited

U.S. PATENT DOCUMENTS

| | | | |
|---|---|---|---|
| 3,373,551 | 3/1968 | Gillono et al. | 57/262 |
| 3,664,109 | 5/1972 | Escursell-Prat | 57/262 X |
| 4,565,062 | 1/1986 | Nickolay | 242/35.6 E X |
| 4,798,348 | 1/1989 | Matsui et al. | 242/35.6 E |
| 4,880,176 | 11/1989 | Matsui et al. | 242/35.6 E |

FOREIGN PATENT DOCUMENTS

| | | | |
|---|---|---|---|
| 2336080 | 8/1974 | Fed. Rep. of Germany | 242/35.6 E |
| 3309 | 3/1964 | Japan | 57/262 |
| 277178 | 11/1988 | Japan | 242/35.6 E |

*Primary Examiner*—Joseph J. Hail, III

*Attorney, Agent, or Firm*—Spensley Horn Jubas & Lubitz

[57] ABSTRACT

A yarn end finding apparatus for a spinning bobbin comprising a lifting member capable of moving along the axis of a bobbin located at a predetermined position, a sensor provided on the lifting member, and an auxiliary yarn end finding member which acts on a chase of the bobbin when the sensor detects the end of the yarn layer of the bobbin.

4 Claims, 5 Drawing Sheets

YARN END FINDING APPARATUS

FIELD OF THE INVENTION

The present invention relates to a yarn end finding apparatus for a spinning bobbin.

RELATED ART STATEMENT

Spinning bobbins produced on a spinning frame are subjected to a bunch unwinding process to extend a predetermined length of a yarn from each spinning bobbin prior to supplying the spinning bobbins to automatic winders in the subsequent winding process. Generally, the automatic winder is provided on the bobbin supply side thereof with a yarn end finding apparatus for such a purpose.

Bunches are classified into top bunches formed at the upper end of bobbins, and bottom bunches formed at the lower end of bobbins. The yarn end finding apparatus unwinds or removes the bunch, either the top bunch or the bottom bunch, takes out a predetermined length of a yarn from the bobbin, and then inserts the free portion of the yarn in the central bore of the bobbin or winds lightly several turns around the yarn layer, or supplies the bobbin to a bobbin magazine so that the free yarn end is sucked in and held by a suction apparatus. The yarn end of the bobbin is processed as mentioned above depending on the type of the automatic winder.

The yarn end finding apparatus must be capable of dealing with bobbins of various conditions, such as spinning bobbins each having a bunch formed at a predetermined position, full spinning bobbins not having any bunch, a large number of semifull spinning bobbins doffed from fine spinning frames for changing a lot of bobbins in production for another lot of bobbins, and bobbins having residual yarn discharged from an automatic winder and to be fed again to the automatic winder.

Accordingly, the yarn end finding apparatus must be capable of finding yarn ends on bobbins of various conditions.

OBJECT AND SUMMARY OF THE INVENTION

It is an object of the present invention to provide a yarn end finding apparatus which is capable of finding yarn ends on bobbins of various conditions.

An embodiment of the present invention provides a yarn end finding apparatus comprising: a lifting member capable of moving along the axis of a bobbin located at a predetermined position; a sensor for detecting an end of a yarn layer of a bobbin, provided on the lifting member; and an auxiliary yarn end finding member which acts on a chase of the bobbin when the sensor detects the end of the yarn layer of the bobbin.

The yarn end finding apparatus of the present invention may be used for not only an automatic winder but also a yarn end piecing apparatus in a spinning frame.

DETAILED DESCRIPTION OF PREFERRED EMBODIMENTS

A yarn end finding apparatus according to an embodiment of the present invention will be described hereinafter with reference to the accompanying drawings.

Figure 5:
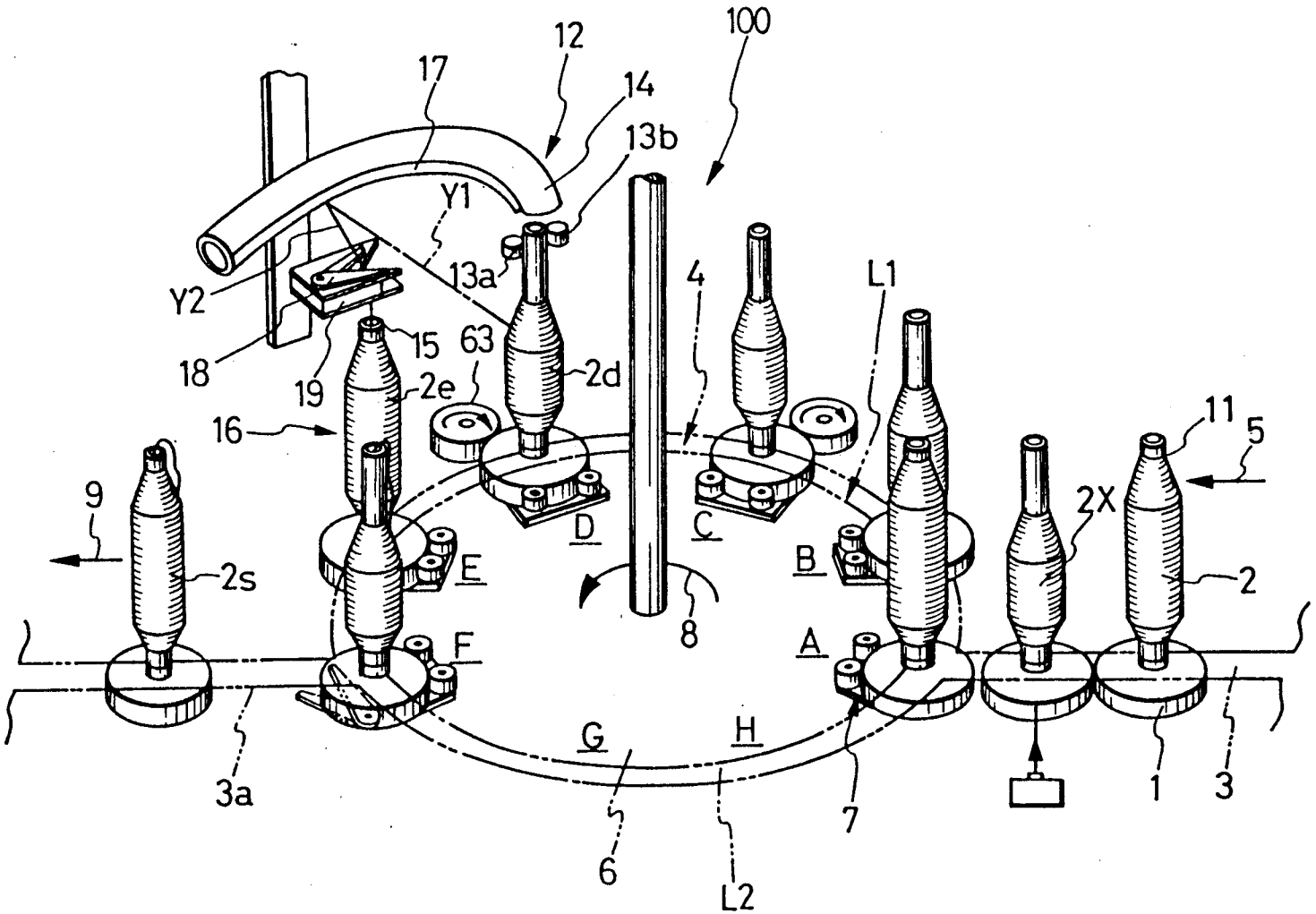
FIG. 5 is a perspective view showing an example of the general whole constitution of a yarn end finding apparatus of an embodiment of the present invention.

FIG. 5 shows, by way of example, a yarn end finding apparatus for finding the yarn end of a bobbin (or a cop) of a top bunch type having a bunch formed at the upper end thereof.

A circular conveying path 4 is formed between conveying paths 3 and 3*a* along which bobbins 2 mounted respectively on trays 1. A receiving station A and a delivery station B on the circular conveying path 4 are connected respectively to the conveying path 3 and the conveying path 3*a*. A section of the circular conveying path 4 extending from the receiving station A via processing stations B, C, D and E to the delivery station F is a feed path for a yarn end finding operation, and a section of the circular conveying path 4 extending from the delivery station F via stations G and H to the receiving station A is a return path for feeding back bobbins with which the yarn end finding operation has not successively achieved.

Bobbins 2 doffed from a spinning frame are conveyed along the conveying path 3 in an upright position on the trays 1 in the direction of an arrow 5 toward the receiving station A of a yarn end finding apparatus 100. Tray accepting devices 7 for accepting the trays respectively mounting the bobbins 2 are arranged at regular angular intervals on a rotary table 6. The rotary table 6 is rotated intermittently in the direction of an arrow 8 to locate the trays 1 accepted by the tray accepting devices 7 at the receiving station A sequentially at the processing stations B, C, D and E and the delivery station F. The tray 1 mounting a bobbin 2 with which the yarn end finding operation has successfully been achieved is delivered from the delivery station F along the conveying path 3*a* in the direction of an arrow 9 toward a winder.

The station B is provided, when the yarn end finding apparatus is used for finding yarn ends on bobbins of a bottom bunch type, with a bottom bunch cutting device for cutting bottom bunches, which is used only for processing bobbins of a bottom bunch type. Since this embodiment is intended for use in finding yarn ends on bobbins of a top bunch type, the station B is not provided with any bottom bunch cutting device, and hence the bobbin 2 is merely stopped temporarily at the station B. The station C is provided with a searching mechanism for searching coils of yarn wound around a yarn layer of a bobbin to cause a back wind, namely, the coils of yarn, to float from the surface of the yarn layer of the bobbin.

The station D is provided with a top bunch unwinding and sucking device 12 comprising a pair of rollers 13*a* and 13*b* disposed with the axes of rotation thereof tilted at a small angle so as to be rotated and pressed against the top bunch to unwind the top bunch, and a suction pipe 14 having an inlet opening disposed near the upper end of the bobbin 2 located at the station D to suck in the top bunch removed from the upper end of the bobbin 2.

The station E is provided with a yarn end inserting mechanism 16 for cutting a free yarn end pulled out from the bobbin 2 in a predetermined length and for inserting the predetermined length of the free yarn end in the hole 15 of the take-up tube of the bobbin 2.

When a bobbin 2*e* is located at the station E, a free yarn end Y2 is stretched between the bobbin 2*e* and a slit 17 formed in the suction pipe 14 in a position depending on tension applied to the free yarn end Y2 by the agency of the suction of the suction pipe 14. A cutting device 18 and a yarn sensor 19 are disposed on the passage of the stretched free yarn end Y2 at a position above the upper end of the bobbin 2*e* located at the station E so that the stretched free yarn end Y2 enter the cutting device 18 naturally as the bobbin 2*e* is transferred from the station D to the station E.

Although a photoelectric sensor, a capacitive sensor, a piezoelectric sensor or a microswitch of a wire actuator type may be used as the yarn sensor 19, preferably a photoelectric sensor is used in view of response characteristics, durability and reliability.

Figure 1:
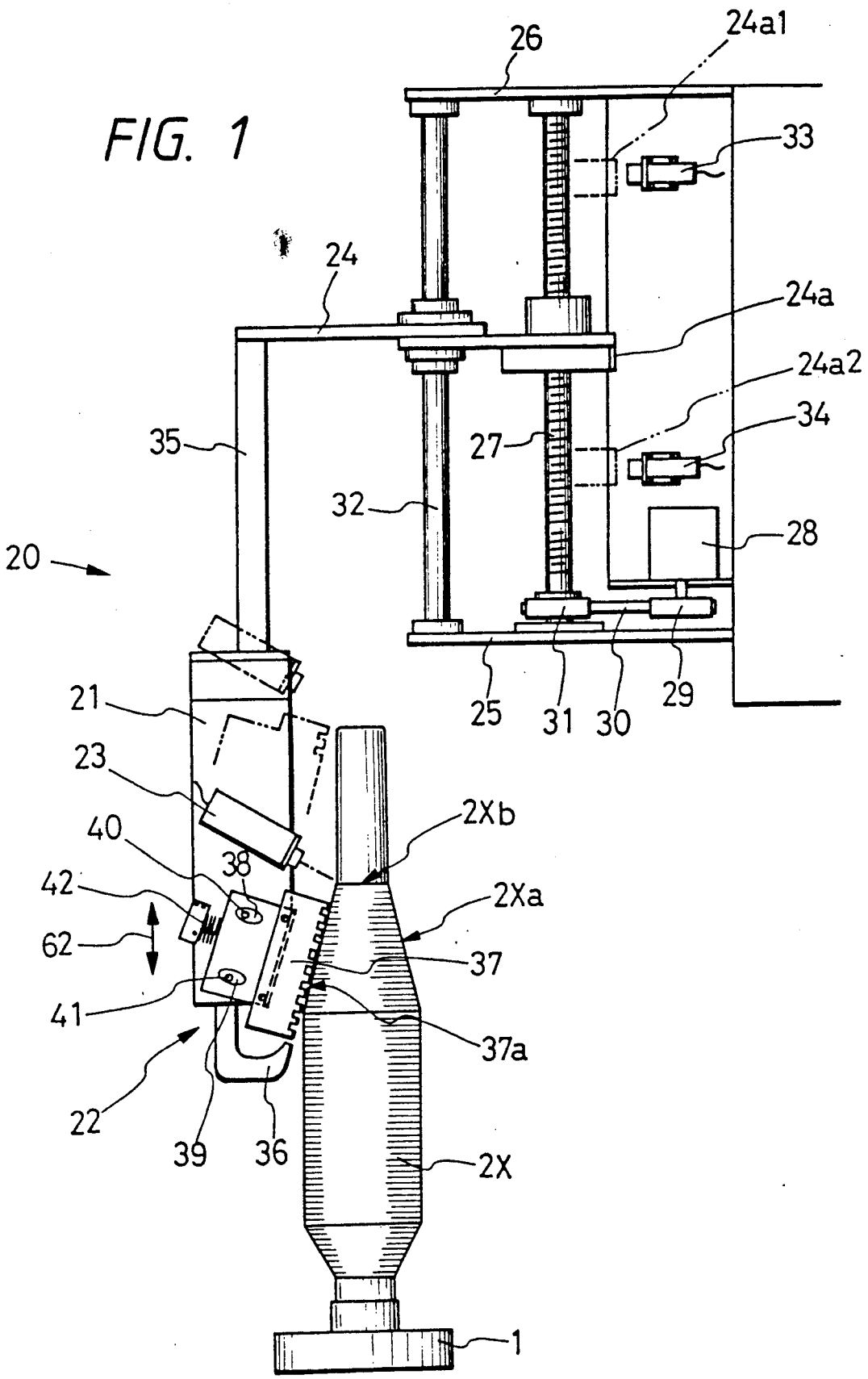
FIG. 1 is a front elevation showing one embodiment of an auxiliary yarn end finding device of the present invention.

The yarn end finding apparatus 100 is provided with a yarn end finding device 20 (FIG. 1) for special bobbins at the station B, C or D. Referring to FIG. 1, the yarn end finding device 20 comprises a lifting member 21 capable of vertically moving along the axis of a bobbin 2X located at the station provided with the yarn end finding device 20, an auxiliary yarn end finding member 22 mounted on the lifting member 21, and an upper end detecting device 23 for detecting the upper end of the yarn layer of the bobbin 2X. The lifting member 21 is suspended from a lifting plate 24. The lifting plate 24 is in ball-and-screw engagement with a ball-screw shaft 27 rotatably supported on fixed frame members 25 and 26. As the ball-screw shaft 27 is rotated by a driving mechanism including a motor 28, a driving belt pulley 29 fixed to the output shaft of the motor 28, a driven belt pulley 31 fixed to the ball-screw shaft 27, and a belt extended between the driving belt pulley 29 and the driven belt pulley 31, the lifting plate 24 moves vertically along a guide rod 32.

The combination of the ball-screw shaft 27 and the driving mechanism may be substituted by a linear motor, a hydraulic actuator or a pneumatic actuator. Proximity sensors 33 and 34 are disposed near the ball-screw shaft 27 to detect the arrival of the lifting plate 24 respectively at the uppermost position and the lowermost position.

The lifting member 21 is connected to the lifting plate 24 by a rod 35. The upper end sensor 23 for detecting the upper end of the yarn layer of a bobbin, an auxiliary jet nozzle 36 and a yarn end finding unit 22 are attached to the lifting member 21.

The yarn end finding unit 22 has a contact member 37 having a contact surface provided with teeth 37*a*. The contact member 37 is supported by pins 40 and 41 loosely received in slots 38 and 39 formed in the contact member 37 so that the contact surface thereof fits the surface of a bobbin, and is biased toward the surface of a bobbin by a compression spring 42. The contact surface of the contact member 37 may be provided with a highly frictional rubber plate or a brush instead of the teeth 37*a*.

Functions of the yarn end finding apparatus will be described hereinafter.

First Embodiment (FIG. 1)

In a yarn end finding apparatus in a first embodiment according to the present invention, the yarn end finding device 20 shown in FIG. 1 is provided at the station D. Upon the arrival of a bobbin at the station D, the lifting member 21 is lowered regardless of the size of the bobbin until the upper end sensor 23 detects the upper end of the yarn layer of the bobbin. In this state, the contact member 37 is in contact with the chase of the bobbin. Then the lifting member 21 is moved alternately up and down several times while air is jetted by the jet nozzle 36 to find the yarn end of the yarn layer of the bobbin and to blow the yarn end upward. Consequently, the yarn end is sucked in and held by the suction pipe 14 (FIG. 5) disposed above the bobbin. The bobbin is rotated by a driving roller 63 so that the yarn is unwound.

Figure 2:
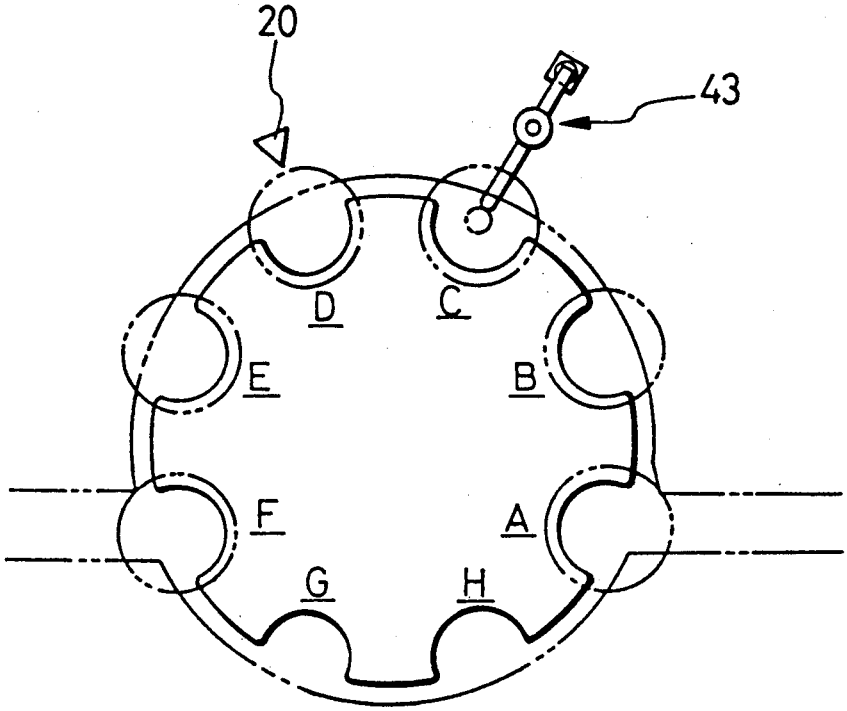
FIG. 2 is a plan view showing a bobbin conveying path of a yarn end finding apparatus.
Figure 3:
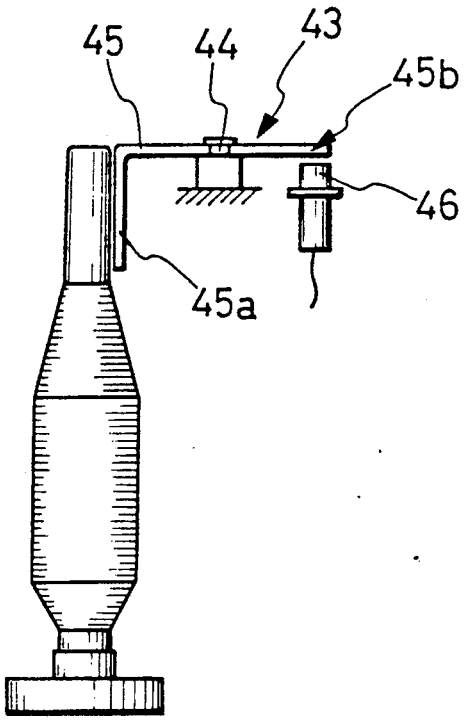
FIG. 3 is a front elevation of an exemplary semifull bobbin detecting device.

Second Embodiment (FIGS. 2 and 3)

In a yarn end finding apparatus in a second embodiment according to the present invention, the yarn end finding device 20 shown in FIG. 1 is provided at the station D, and a semifull bobbin detecting device 43 as shown in FIG. 3 is provided at the station D or at the station C immediately before the station D.

Upon the arrival of a bobbin at the station D, the semifull bobbin detecting device 43 examines the bobbin to see whether the bobbin is a full bobbin whether the bobbin is a semifull bobbin. The semifull bobbin detecting device 43 actuates the yarn end finding device 20 only when the bobbin is a semifull bobbin. Referring to FIG. 3, the semifull bobbin detecting device 43, for example, comprises a fixed pin 44, an L-shaped feeler 45 having a vertical feeling leg 45*a* at one end thereof and pivotally supported on the fixed pin 44, and a proximity sensor 46 provided opposite to the other end 45*b* of the feeler 45. When a full bobbin is delivered to the station D, the feeler 45 is turned on the fixed pin 44 by the full bobbin engaging the vertical feeling leg 45*a*, consequently, the other end 45*b* of the feeler 45 moves away from the proximity sensor 46, so that the proximity sensor 46 detects the arrival of the full bobbin at the station D and provides a full bobbin detection signal.

In such a case, the yarn end finding device 20 is not actuated. On the other hand, when a semifull bobbin is delivered to the station D, the proximity sensor 46 provides a semifull bobbin detection signal to actuate the yarn end finding device 20. Then, the lifting member 21 is lowered until the upper end sensor 23 detects the upper end of the yarn layer of the semifull bobbin, and then the contact member 37 is moved alternately up and down several times to find the yarn end.

Figure 4:
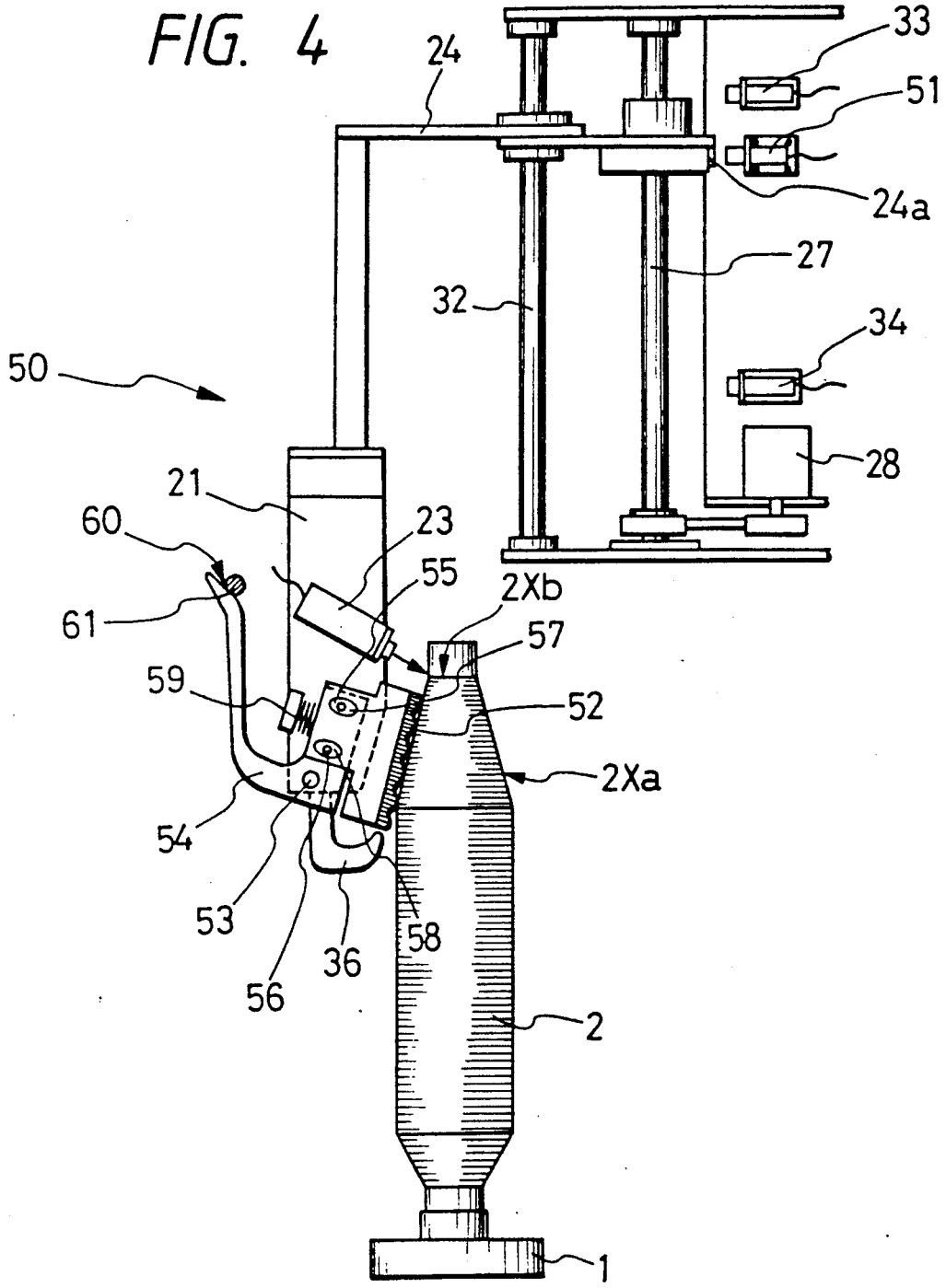
FIG. 4 is a front elevation of another embodiment of the auxiliary yarn end finding device of the present invention.

Third Embodiment (FIG. 4)

A yarn end finding device 50, which is similar to the yarn end finding device 20 in function and construction, is provided at the station D. In the yarn end finding device 50, the downward travel of the sensor 23 is detected. When a semifull bobbin is delivered to the station D, the downward travel of the upper end sensor 23 exceeds a predetermined value. Then the yarn end finding device 50 continues the yarn end finding operation. As shown in FIG. 4, the yarn end finding device 40 is provided with a proximity sensor 51 in addition to the proximity sensors 33 and 34 for detecting the arrival of the lifting plate 24 respectively at the uppermost and lowermost positions.

The proximity sensor 51 is disposed at a position corresponding to a position where the upper end sensor 23 moving downward together with the lifting member 21 detects the upper end 2Xb of a full bobbin. Accordingly, when a full bobbin is delivered to the station D, the upper end sensor 23 detects the yarn layer of the full bobbin simultaneously with the detection of the rear end 24*a* of the lifting plate 24 by the proximity sensor 51. In such a case, the lifting member 21 starts moving upward immediately after the detection of the upper end of the yarn layer of the full bobbin by the upper end sensor 23.

On the other hand, when a semifull bobbin 2X is delivered to the station D, the lifting member 21 continues to move downward after the proximity sensor 51 has detected the rear end 24*a* of the lifting plate 24. In such a case, a valve provided in an air supply line connected to the jet nozzle 36 is opened to jet air through the jet nozzle 36. As shown in FIG. 4, a lever 54 is supported pivotally on the lifting member 21 by a pin 53. A contact member 52 to be brought into contact with the chase of a bobbin is mounted on the lever 54 by receiving pins 55 and 56 attached to the lever 54 in slots 57 and 58 formed therein, and the contact member 52 is biased toward an operating position by a spring 59. A cam surface 60 is formed on one extremity of the lever 54 to shift the lever 54 between two positions with a pin 61 fixed to a frame. When the lifting member 21 moving downward arrives at the position of the proximity sensor 51, the lever 54 leaves the pin 61 and the lever 54 is turned clockwise by a spring, not shown, wound on the pin 53 to allow a contact member 52 to come into contact with the chase 2Xa of a bobbin.

That is, the proximity sensor 51 provides a signal to open the valve for supplying air to the jet nozzle 36, and the pin 61 releases the lever 54 to allow the contact member 52 to move to the operating position.

In either foregoing embodiment, the lifting member 52 moves downward until the upper end sensor 23 detects the upper end of the yarn layer of a bobbin, and then the contact member 52 engages the chase of a semifull bobbin. Thus, the yarn ends of either full bobbins or semifull bobbins supplied to the yarn end finding apparatus can be found.

In finding the yarn end of a semifull bobbin as shown in FIG. 1, operating the motor 28 alternately in opposite directions for a short time to shake the contact member 37 in a small stroke as indicated by a double-head arrow 62 further ensures the yarn end finding function of the air jetted from the jet nozzle 36. Although semifull bobbins have yarn ends wound around the chases thereof by a yarn end winding system in the fine spinning process in most cases, some semifull bobbins have yarn ends depending from the chases thereof in some cases. However, in either case, the yarn end can easily be separated from the surface of the bobbin by rubbing the chase of the bobbin with the contact member 37.

Although the yarn end finding device 20 or 50 is provided at the station D (FIGS. 2), it is also possible to provide the yarn end finding device 20 or 50 at other station, for example, the station B, and to provide the semifull bobbin detecting device 43 (FIG. 2) at the station A.

Figure 6:
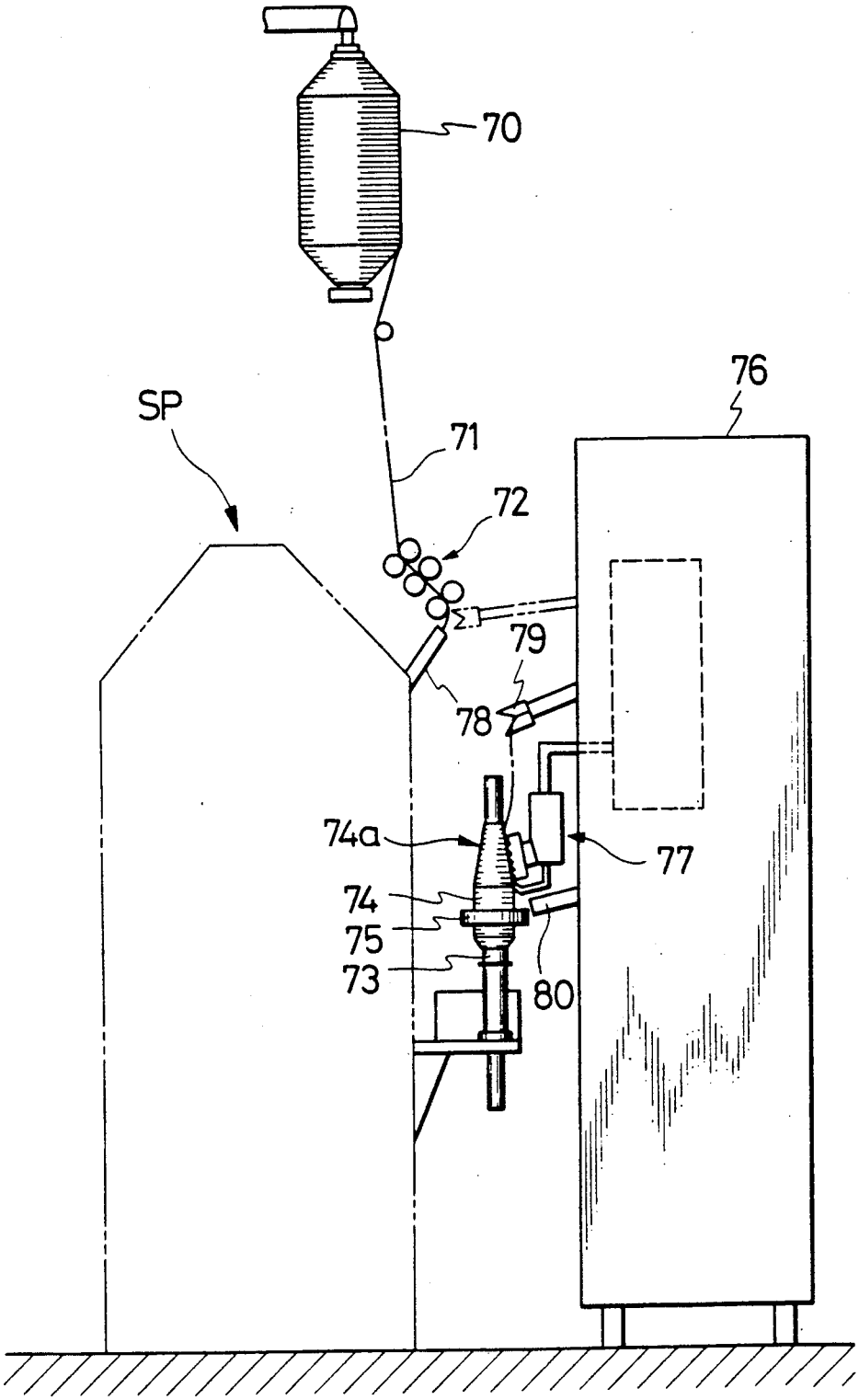
FIG. 6 is a side elevation showing a general arrangement of a yarn end finding device according to an embodiment of the present invention as applied to a ring spinning frame.

An exemplary application of the foregoing yarn end finding device in combination of a piecing device incorporated into a ring spinning frame will be described hereinafter with reference to FIG. 6.

A spinning frame SP comprises a plurality of drafting parts 72 and a plurality of spindles 73 successively arranged along the longitudinal direction thereof, namely, a direction perpendicular to the sheet. The drafting units 72 draft rovings 71 drawn out from roving packages 70 into a fiber bundle, and then spindles 73 and travelers 75 twists the fiber bundle to spin yarns winding the twisted yarns around bobbins 74 put on the spindles 73.

A piecing device is mounted on a cart 76, which moves along rails extended along the ring spinning frame SP. A yarn end finding device 77 embodying the present invention may be mounted on the cart 76. When yarn breakage occurs, for example, between the drafting unit 72 and the spindle 73 during the spinning operation of the ring spinning frame SP, a yarn end on the side of the spindle is wound on the bobbin 74, while the fiber bundle being delivered from the drafting unit 72 is sucked into a suction pipe 78 until the fiber bundle and the yarn end are pieced together. Upon the detection of end breakage, the cart 76 stops opposite to the spindle 73 of a spinning unit where the end breakage has occurred. Then, the yarn end finding device 77 is actuated for a yarn end finding operation similar to that of the yarn end finding device of FIG. 1 to find the yarn end wound on the chase 74*a* of the bobbin in process. Then, the yarn end picked up from the bobbin is held by a yarn end holding member 79, which takes the yarn end upward toward the drafting unit to join the yarn end and the fiber bundle and, at the same time, a threading member 80 brings the yarn extending from the bobbin into engagement with the traveler 75. After the yarn piecing operation has thus completed, the yarn end finding device 77 is retracted from the operating position into the cart 76. It is desirable that the yarn end finding device 77, which is similar to the yarn end finding device 20 of FIG. 1, is mounted on the cart 76 so as to be advanced toward and retracted from the operating position near the spindle 73.

As is apparent from the foregoing description, according to embodiments of the present invention, an upper end sensor for detecting the upper end of the yarn layer of a bobbin, namely, the boundary between the yarn layer and the take-up tube, and an auxiliary yarn end finding member to be brought into contact with the chase of a bobbin are mounted on a lifting member capable of being moved along the axis of the bobbin, and a yarn end finding operation is started to find the yarn end of the bobbin upon the detection of the upper end of the yarn layer of the bobbin by the upper end sensor. Accordingly, the yarn end finding operation for a semifull bobbin is achieved surely and the possibility of failure in the yarn end finding operation can be reduced.

What is claimed is:

1. A yarn end finding device comprising:

a lifting member capable of moving substantially in the axial direction of a bobbin located at a predetermined position;

means for moving the lifting member substantially in the axial direction of the bobbin;

a sensor for detecting an end of a yarn layer located adjacent a chase of the bobbin, the sensor being provided on the lifting member; and an auxiliary yarn end finding member which acts on the chase of the bobbin upon detection by the sensor of the end of the yarn layer of the bobbin, wherein said auxiliary yarn end finding member includes a contact member which is supported on the lifting member to be urged to fit the chase of the bobbin, said auxiliary yarn end finding member is moved alternatively up and down to find the yarn end of the yarn layer of the bobbin, wherein the sensor and the contact member are located with respect to each other such that upon detection by the sensor of the upper end of the yarn layer of the bobbin, the contact member is located in contact with the chase of the bobbin.

2. The yarn end finding device as claimed in claim 1, wherein an air nozzle for blowing upward a yarn end found from the yarn layer of the bobbin is further provided on the lifting member.

3. A yarn end finding device comprising:

a lifting member capable of moving substantially in the axial direction of a bobbin located at a predetermined position;

means for moving the lifting member substantially in the axial direction of the bobbin;

a sensor for detecting an end of a yarn layer located adjacent a chase of the bobbin, the sensor being provided on the lifting member; and an auxiliary yarn end finding member which acts on the chase of the bobbin upon detection by the sensor of the end of the yarn layer of the bobbin, wherein an air nozzle for blowing upward a yarn end found from the yarn layer of the bobbin is further provided on the lifting member, said auxiliary yarn end finding member includes a contact member which is supported on the lifting member to be urged to fit the chase of the bobbin, said auxiliary yarn end finding member is moved alternatively up and down to find the yarn end of the yarn layer of the bobbin, and wherein the sensor and the contact member are located with respect to each other such that upon detection by the sensor of the upper end of the yarn layer of the bobbin, the contact member is located in contact with the chase of the bobbin, and the means for moving comprises means for moving the lifting member alternately up and down several times while air is jetted by the air nozzle.

4. A yarn end finding apparatus which is provided adjacent a transporting path for transporting a spinning bobbin carried on a tray from a spinning frame to a winder to release a bunch winding of a bobbin, said yarn end finding apparatus comprising:

an auxiliary yarn end finding device having a lifting member capable of moving substantially in the axial direction of a bobbin located at a predetermined position;

means for moving the lifting member substantially in the axial direction of the bobbin;

a sensor for detecting an end of a yarn layer located adjacent a chase of the bobbin, the sensor being provided on the lifting member; and an auxiliary yarn end finding member which acts on the chase of the bobbin upon the detection by the sensor of the end of the yarn layer of the bobbin, wherein said auxiliary yarn end finding member includes a contact member which is to be urged to fit the chase of the bobbin, wherein the sensor and the contact member are located with respect to each other such that upon detection by the sensor of the upper end of the yarn layer of the bobbin, the contact member is located in contact with the chase of the bobbin.

* * * * *